United States Patent [19]

Hart et al.

[11] 4,340,442

[45] Jul. 20, 1982

[54] STARCH FIBRIDS USEFUL IN ENHANCING THE PHYSICAL PROPERTIES OF PAPER, AND PROCESS OF PREPARING SAME

[75] Inventors: John R. Hart, Savannah, Ga.; Stanley G. Juergens, Cincinnati; William E. McCormack, Hamilton, both of Ohio

[73] Assignee: Champion International Corporation, Stamford, Conn.

[21] Appl. No.: 161,664

[22] Filed: Jun. 23, 1980

Related U.S. Application Data

[63] Continuation of Ser. No. 958,187, Nov. 6, 1978, abandoned.

[51] Int. Cl.[3] ..... D21H 5/12

[52] U.S. Cl. ..... 162/146; 162/190; 264/13; 264/14

[58] Field of Search ..... 162/146, 157 R, 175, 162/190, 181 R, 181 B; 106/210, 213, 217, 214; 264/11, 13, 14, 186; 428/400

[56] References Cited

U.S. PATENT DOCUMENTS

| | | | |
|---|---|---|---|
| 2,902,336 | 9/1959 | Hiemstra et al. | 264/186 |
| 2,999,788 | 9/1961 | Morgan | 162/157 R |
| 3,441,473 | 4/1969 | Brundige et al. | 162/146 |
| 4,139,699 | 2/1979 | Hernandez et al. | 536/109 |
| 4,205,025 | 5/1980 | Hart et al. | 162/146 |

FOREIGN PATENT DOCUMENTS

| | | |
|---|---|---|
| 847431 | 4/1960 | United Kingdom . |

*Primary Examiner*—Peter Chin

*Attorney, Agent, or Firm*—Evelyn M. Sommer

[57] ABSTRACT

Starch fibrids useful in enhancing the physical properties of non-woven webs, e.g., paper, are produced by a process which comprises providing an aqueous, alkaline solution of a water-insoluble starch in a finely divided form, e.g., in the form of an aerosol, and introducing the finely divided starch solution into an agitated, aqueous precipitating medium comprising a precipitating salt to thereby produce starch fibrids characterized by having both film and fiber morphology. The starch fibrids are recovered from the salt-containing liquid and may be incorporated into paper to improve the physical properties thereof.

13 Claims, No Drawings

STARCH FIBRIDS USEFUL IN ENHANCING THE PHYSICAL PROPERTIES OF PAPER, AND PROCESS OF PREPARING SAME

This is a continuation of application Ser. No. 958,187 filed Nov. 6, 1978, now abandoned.

This invention relates to starch fibrids and to the process of preparing the same. The invention also relates to non-woven webs, such as paper, containing starch fibrids. Such non-woven webs have improved strength properties due to the inclusion of the starch fibrids therein.

In the art of papermaking, it is known to add various water-soluble materials to the wet pulp fibers prior to the formation of sheets therefrom, in order to promote interfiber bonding. Such materials may be referred to as binders and one important class of materials which have heretofore been used as binders is the class comprising water-soluble or solubilized starch. Papers which have water-soluble binders such as starch incorporated therein exhibit higher strength when compared with papers which do not have such additives incorporated therein.

Although the use of solubilized starch as a binder in the formation of paper has found widespread acceptance by the paper industry, there have been various shortcomings associated with the use of such starch as a binder. For example, the papermaking fibers have a low retention rate for the starch. Thus, a portion of the starch that is used in the formation of paper passes out of the paper mill as a waste effluent component.

Not only is such starch loss objectionable in that it results in an unnecessary expense to the paper manufacturer, but it is also objectionable in that the lost starch serves to pollute the waters surrounding the paper mill.

An additional problem is encountered in the use of water-soluble starch as a papermaking additive. Namely, if the starch is added to paper fibers in amounts in excess of about 6 percent by weight, based upon the weight of the paper fibers, the resultant wet fiber web exhibits undesirable characteristics, such as excessive tackiness, causing the wet web to adhere to the papermaking apparatus. Thus, only a limited amount of water-soluble starch may be added to paper and accordingly the physical properties of paper can be improved to a limited extent by means of such starches.

Commonly-assigned U.S. patent application Ser. No. 643,501, filed Dec. 22, 1975 to J. Robert Hart et al discloses a process for the formation of hydrophobic fibrids from water-soluble film forming materials by dissolving the film forming material in an aqueous medium and thereafter injecting the resultant aqueous solution into a non-aqueous precipitating medium under conditions of shear thereby forming fibrids. The fibrids are recovered and treated to render them hydrophobic and may thereafter be used as a component in non-woven webs.

It has now been found that normally water-insoluble starch in the form of fibrids having both film and fiber morphology may be used as a binder in the formation of paper. The resulting paper exhibits improved physical properties including higher tensile strength, bursting strength, and folding indurance, and decreased air permeability. Moreover, the starch fibrids of the present invention are readily retained in large quantities by paper fibers without rendering the wet web tacky. Thus, starch fibrids may be used in larger amounts than can solubilized starch, thereby resulting in improved physical properties of the resultant paper.

The starch fibrids of the present invention are produced by a process which comprises providing an aqueous, alkaline solution of a normally water-insoluble starch in finely divided form. The finely divided starch solution is introduced into an agitated, aqueous precipitating medium. The aqueous precipitating medium comprises an aqueous precipitating salt solution. Starch fibrids are thereby formed in the precipitating medium and the starch fibrids thus formed are separated from the aqueos precipitating medium and may be used as a component in a non-woven web, e.g., paper.

The starch fibrids of the present invention serve as excellent binders in paper webs not only by virtue of the adhesive nature of the starch, but also provide good binding characteristics due to mechanical entanglement with the web fibers as a result of the morphology of the starch fibrids.

It has also been found that the starch fibrids of the present invention may be extended by incorporating other, non-soluble materials therein.

Such extender materials may comprise an opacifying pigment, e.g., titanium dioxide, or the like. When the starch fibrids of the present invention are extended with such opacifying additive, the resultant pigmented starch fibrids serve not only to strengthen non-woven webs but additionally increase the opacity of such web. The starch fibrids of the present invention may also be extended by means of the incorporation of a relatively inexpensive additive, such as, for instance, clay therein, to thereby provide starch fibrids of reduced cost.

Surprisingly, it has been found that the extended starch fibrids of the present invention may comprise a high extender to starch ratio, and, yet, they are still capable of increasing the strength properties of a non-woven web, e.g., paper.

The extenders may be incorporated into the starch fibrids by either including the extender in the aqueous, alkaline, solubilized starch prior to its admixture with the precipitating medium, or by including the extender in the aqueous precipitating medium. Preferably, the extender is incorporated into the starch fibrids via the aqueous, alkaline, solubilized starch solution.

The term "fibrid" as used herein refers to a material having a hybrid morphology, i.e., both film and fiber morphology.

As previously indicated, the starch fibrids of the present invention are produced by introducing an aqueous solution in finely divided form into a precipitating medium. The aqueous, alkaline solution of starch may be provided by dissolving a normally water-insoluble natural and/or modified starch into an aqueous, alkaline medium. Preferably, natural or modified corn starch, potato starch, or tapioca starch are employed in the present invention.

An especially preferred starch for use in the present invention is amylose. However, any starch having a high amylose content, such as modified corn starches having amylose contents in the range of 50 percent to 80 percent by weight, is likewise preferred. An important consideration when choosing a starch for use in the present invention is it be water-insoluble. The water-insolubility of the final starch fibrid will be the same as the water-insolubility of the original starch utilized, since there is no chemical modification of the starch utilized in the present invention.

Any suitable alkaline medium may be employed for dissolving the water-insoluble starch. For example, an alkali metal hydroxide may be employed. Preferably, an aqueous sodium hydroxide solution, wherein the sodium hydroxide is used in an amount ranging from about 10 percent to about 25 percent based on the weight of the starch to be dissolved, may be used. The alkali concentration necessary to dissolve the starch will, in part, be dependent upon the amylose content of the starch. A high amylose content starch will necessitate the use of a more concentrated alkali solution while a low amylose content starch will require a lesser alkali concentration. An aqueous sodium hydroxide solution containing about 20 percent sodium hydroxide based upon the weight of the starch to be dissolved in especially preferred.

The starch to be dissolved should be used in an amount ranging from about 2 percent to about 15 percent by weight based on the weight of the water, preferably from about 4 percent to about 10 percent based on the weight of the water.

The starch will readily dissolved into the aqueous, alkaline liquid upon stirring or agitation. In some cases it may be advantageous to heat the liquid during agitation in order to dissolve the starch. Such use of heat may reduce the quantity of alkali needed to solubilize the starch and may also reduce the visiosity of the starch solution.

As indicated earlier, an insoluble extender may be incorporated into the starch fibrids via the aqueous, alkaline liquid. Such materials may comprise an additive such as inorganic pigments, e.g., titanium dioxide, clays, calcium carbonate; a synthetic, organic opacifying agent, e.g., ureaformaldehyde pigments or the like.

The extender may be added to the aqueous, alkaline liquid prior to, or subsequent to the addition of the starch. The extender may be used in amounts of between about 1 and about 500 percent by weight, based upon the weight of the starch.

Preferably, the extender should be used in an amount ranging from about 15 percent to 20 percent by weight, based on the weight of the starch. The added material will thus form an integral part of the starch fibrids.

The preferred amount of extender will be determined by the intended use of the fibrid. If no extender or pigment is added to the fibrid, the fibrid becomes translucent upon drying. To prepare fibrids that have optical properties similar to those of bleached wood pulp, pigments should be utilized in an amount ranging from about 10 percent to about 100 percent by weight based upon the weight of the starch. Larger quantities of pigments, e.g., up to 500 percent by weight, based upon the weight of the starch, may be incorporated for specific end uses.

According to one embodiment of this invention, the white water effluent from a papermaking process may be rendered alkaline, e.g., by the addition of sodium hydroxide, and used as the aqueous, alkaline liquid for solubilizing the starch. The valuable materials contained in the white water, such as inorganic pigments and pulp fibers, which would ordinarily be lost as waste effluent, will be incorporated into the resultant starch fibrids and be recovered for use in the manufacture of paper.

It is also contemplated to incorporate water-soluble paper treating agents into the starch fibrids. Such additive may comprise a dye, slimicide, fungicide, sizing agent, or the like. The additive can be incorporated into the starch fibrids via the aqueous, alkaline liquid and can be added to said liquid prior to, or subsequent to the addition of starch thereto.

Following the formation of the solubilized starch-containing liquid, the liquid is introduced into a device for finely dividing the liquid starch solution, e.g., a spray nozzle or the like, and the finely divided, solubilized starch-containing liquid is then introduced into an agitated aqueous, precipitating medium.

Any mechanical means may be used for finely dividing the alkaline starch solution. For instance, an atomization nozzle may be utilized. Suitable atomization nozzles for atomizing the starch solution are described in *Mixing in the Chemical Industries* by Sterbacek and Tausk, Pergamon Press (London 1965) pages 223–226, which is hereby incorporated by reference. The starch solution may also be finely divided by means of a conventional Venturi mixer. Thus, the precipitating medium may be passed through the main pipe in the arrangement shown in FIG. 93 on page 228 of the Sterbacek et al book, while the starch solution is introduced as the auxiliary solution in FIG. 93, particularly where the tube is narrowest. The mixture is thereafter passed into an agitation tank. Venturi mixing and other pipeline mixing processes and apparatus which may be utilized are described in the aforesaid Sterbacek et al book at pages 226–229, which are likewise incorporated by reference.

The preferred means for finely dividing the starch solution is an atomization nozzle. The spray nozzle may be submerged in the liquid precipitating bath. Preferably, the starch solution is suspended in a gas, i.e., the atomizer is suspended above the agitated precipitating liquid, and the finely divided starch solution is introduced into the precipitating medium in the form of an aerosol. The finely divided starch solution should be directed into and contact a portion of the fluid stream of the precipitating medium so that its spray path is in a direction with the flow of the contacted portion of the precipitation medium. Thus, the spray path of the starch solution should be at an angle of less than 90 degrees with respect to the surface of the precipitating medium. The purpose of directing the spray path in the direction of flow is to cause the shear experienced by the starch droplets to elongate the starch droplets into a preferred morphology. It is preferred that the spray path of the starch solution be directed onto the surface of the fluid stream of the precipitating medium at an angle of between about 30 degrees and 85 degrees when measured as described above.

The morphological characteristics of the starch fibrid products are highly dependent upon the manner in which the precipitation is carried out. The description and identification of variables involved in the precipitation step should be considered in terms of:

(a) the fluid state of the precipitating medium (b) the means of injection of the polymer solution, and (c) the rate of precipitation of the starch.

When the starch is injected into the precipitating salt solution, it will assume a morphology dictated by the fluid state of the salt solution. If the precipitating medium is stagnant or has a laminar shear field, the precipitated starch will be a filament or fiber with easily defined boundries. In a turbulent salt solution, the starch will be randomly twisted, coiled and generally disarranged fibrid product. The turbulant action causes the precipitated starch to have a resemblance of tightly coiled fibers, while a more gentle laminar action given a relatively large quantity of film formation.

The flow rate of the injected starch solution relative to the velocity of the precipitating medium is also important. When the starch flow rate lags the surrounding fluid, a stretching or tensile force is applied to the starch. A rushing or faster starch flow rate will cause an undesirable crimping or balling effect on the precipitated starch fibrid.

The preferred type of fluid shear field for the precipitating medium and the manner of injecting the starch solution will depend upon the rate of precipitation of the starch. If the precipitation rate is very rapid (instantaneous or fraction of a second), a strong shear field is desirable. A slower rate of precipitation demands a more gentle fluid action, for time must be allowed for the fiber to attain sufficient integrity and avoid disruption of the starch morphology.

Many variables alter the rate of precipitation, some of which are (a) composition of the salt solution; (b) concentration of the salt solution; (c) starch composition; and (d) starch concentration.

Any ionizable inorganic or organic salt may be utilized as the precipitating salt. Suitable precipitating salts which may be used in the present invention include, for example, ammonium sulfate, magnesium sulfate, ammonium phosphate, potassium chloride, sodium sulfate, sodium carbonate, sodium bicarbonate, ammonium chloride and aluminum sulfate, sodium acetate, and sodium potassium tartrate. The preferred salt for use in the present invention is ammonium sulfate. The precipitating liquid may contain only a single salt, or it may contain two or more salts. The salt should be present in the precipitating liquid in a concentration ranging from about 25 percent to about 100 percent of the saturation concentration, of the particular salt utilized, in water. The preferred salt concentration is about 50–75 percent of the saturation concentration.

As indicated previously, it is also contemplated that non-soluble extenders and/or soluble modifying agents may be incorporated into the starch fibrids by suspending the extruder and/or dissolving the modifying agent in the precipitating medium prior to the introduction of the finely divided, solubilized starch-containing liquid therein.

Following formation of the starch fibrids in the aqueous precipitating liquid, the starch fibrids are separated from the aqueous precipitating liquid and preferably washed, e.g., by reslurrying the fibrids in water, to remove excess salt therefrom.

The washed starch fibrids may be incorporated into a papermaking wood pulp in an amount ranging from 1 percent to about 60 percent by weight, based on the weight of the dry wood pulp, preferably between about 1 and about 20 percent based on the weight of the wood pulp. Since the starch fibrids are insoluble in water, they are retained more efficiently than a solubilized starch by the papermaking fibers. The starch fibrids of the present invention are compatible with other papermaking activities and may be used in all paper products, e.g., label paper, milk carton board, paper board, etc.

An examination of the paper webs made with the addition of from about 5 percent to about 10 percent by weight of starch fibrids, based on the weight of the dry cellulose fibers, indicates that after the papermaking process has been completed the starch fibrids have been slightly deformed. By virtue of their fibrid nature, they appear to more intimately embrace the cellulose fibers, resulting in a much stronger fiber-to-fiber bonding. It is believed that the fibrid morphology is an essential key for a good binder, since mechanical entanglement, in addition to the adhesive nature of the product appears to contribute to the over-all binding effect.

The starch fibrids of the present invention may also be used as a binder for non-woven webs comprising non-cellulosic fibers. Such non-cellulosic webs may comprise inorganic fibers, such as, for instance, glass, ceramic or asbestos fibers; or organic fibers such as, for instance polyamide, or polyolefin, rayon, nylon or polyester fibers.

As with the cellulosic fiber-containing webs, the morphology of the starch fibrid appears to be an essential element contributing to the ability of the starch fibrid to function as a good binder in a non-cellulose, non-woven web.

An advantage of the incorporation of the starch fibrids of the present invention into a non-woven web is the resultant increase in the strength of the web. Additionally, when the starch fibrids of the present invention are incorporated into a paper web, there is a reduction in the amount of surface sizing necessary to be added to the paper web. Still another advantage of the use of the fibrids of the present invention in a paper web is an increased retention of the papermaking additives by the paper web, resulting in a reduction of both the suspended and soluble solids in the final papermaking effluent. This can be a major factor in reducing the pollution of some of the liquid effluents in a paper mill, as well as improving the economics of the system. Moreover, there is a resulting increase in the amount of reusable water in papermaking operations.

The following examples serve to illustrate the present invention.

EXAMPLE 1

A hybrid corn starch rich in amylose (Amylomaize VII available from American Maize-Products Co.) is dissolved in a sodium hydroxide solution (20 percent by weight based upon the starch), and the starch solution is diluted to 4 percent total solids (T.S.) before further processing. This solution is sprayed as an aerosol, onto the surface of a rapidly mixing precipitating medium of 40 percent ammonium sulfate. The material that precipitates is collected at about 10 percent T.S., reslurried in water to remove excessive amounts of salt solution, and again collected at about 10 percent T.S. The product has a fibrid type morphology. The fibrids are added to a wood pulp slurry at various levels and formed into a paper substrate.

EXAMPLE 2

A starch solution is prepared as in Example 1 with the exception that 10 percent titanium dioxide pigment, based upon starch, is blended into the starch solution before precipitation. The resulting fibrids contain substantially all of the dispersed pigment, but are more opaque and whiter than those of Example 1.

EXAMPLE 3

A black liquor from a Kraft pulping process is used as the alkaline medium for dissolving the starch used in Example 1. The starch-black liquor solution is very dark in color. This solution is introduced, via an injection nozzle into an agitated ammonium sulfate precipitating medium and a fibrous product results. The fibrids are very dark in color and substantially incorporate all dissolved and particulate material originally present in the black liquor solution.

EXAMPLE 4

A starch solution is prepared as in Example 1. This solution is sprayed onto the surface of a 17 percent aluminum sulfate precipitating medium and a fibrid product results.

EXAMPLE 5

A pearl starch (CPC 3372, available from Corn Products) is dissolved in sodium hydroxide (20 percent sodium hydroxide based upon starch) and finally diluted to a 2 percent T.S. solution. This solution is sprayed onto the surface of an agitated, of concentrated ammonium sulfate liquid. A fibrid material precipitates and is then collected and washed. These fibrids are very compatible when added to wood pulp and formed into a paper substrate.

EXAMPLE 6

The procedure of Example 5 is repeated, however the starch solution is injected into the auxiliary tube of a Venturi mixer in a pipeline carrying the ammonium sulfate solution, and the mixture is passed to an agitation vessel where starch fibrids are precipitated. The washed and collected fibrids are substantially identical to those of Example 5.

EXAMPLE 7

A blended starch is prepared by admixing equal parts of the starch used in Example 1 (a high amylose hybrid corn starch) and the starch used in Example 5 (pearl starch). The procedure of Example 5 is repeated to produce blended starch fibrids.

EXAMPLE 8

The starch fibrids produced in Example 1 are incorporated into a papermaking stock. Paper sheets are produced which contained 5 percent by weight of the starch fibrids of Example 1. Other paper sheets are prepared which contain 10 percent by weight of the starch fibrids of example 1. The physical properties of the sheets are tested and recorded.

Two sets of paper sheets which contain solubilized cationic starch in amounts of 2 percent and 4 percent by weight respectively are prepared. The physical properties of these sheets are tested and recorded.

Paper sheets consisting of 100 percent wood pulp with no additive are prepared. The physical properties of these sheets are tested and recorded.

The strength properties of the paper sheets containing the starch fibrids of the present invention, and paper sheets containing solubilized, cationic, starch are compared in Table 1, below. The values expressed therein represent the percent change over the paper sheets having no additives.

TABLE 1

| | Solubilized Cationic Starch | | Starch Fibrids | |
|---|---|---|---|---|
| | [2%] | [4%] | [5%] | [10%] |
| Tensile, pli | 18 | 25 | 28 | 37 |
| Mullen, psi | 22 | 36 | 21 | 36 |
| Fold, MIT | 40 | 250 | 360 | 690 |
| Densometer, Gurley, sec. | −33 | −40 | 62 | 250 |
| Tear, gm/sheet | −7 | −16 | −17 | −35 |

As seen in Table 1, the addition of starch fibrids to wood pulp increases the final sheet strength. Starch fibrids do not increase the sheet strength per se, but increase the internal bonding of the wood fibers. Cationic starches are commonly added to wood pulp furnishes for this same reason, i.e., to increase internal bonding. Results in Table 1 show that tensile strength and fold endurance of fibrid sheets increased over both control and cationic starch sheets. Mullen or burst strength of the fibrid and cationic starch sheets increased about the same amount relative to the control. These three physical tests are indicative of increased internal bonding of the wood fibers.

The porosity or air permeability measured by a Gurley Densometer is a recording of the seconds required for a specific volume of air to pass through a substrate, with an impermeable substance having an infinite value. Table 1 shows that fibrid contained sheets had higher Gurley values, meaning less permeability than the control, whereas the sheets containing cationic starch were more open or more porous.

The tear resistance of paper sheets will decrease when internal bonding is increased and the results so indicate. The greater loss in tear resistance with the fibrid samples is due to a higher degree of internal bonding and due to a lesser quantity of wood fibers present in the sheet.

What is claimed is:

1. A process for the production of a paper product including water insoluble starch fibrids, which comprises:

(a) providing an aqueous, alkaline solution of a normally water-insoluble starch in finely divided form, (b) suspending said finely divided starch solution in a gas and introducing the resulting aerosol into an agitated, aqueous precipitating medium at an angle of less than 90 degrees with the surface of said aqueous precipitating medium, said aqueous precipitating medium comprising a salt solution, to thereby produce starch fibrids characterized by having both film and fiber morphology, (c) separating said starch fibrids which are insoluble in water from said aqueous precipitating medium, (d) incorporating said starch fibrids into a papermaking wood pulp in an amount ranging from 1 percent to about 60 percent by weight, and (e) preparing a paper product from said papermaking wood pulp including said starch fibrids.

2. The process of claim 1 wherein said aerosol is introduced into said precipitating medium at an angle of between about 30 and about 85 degrees with the surface of said liquid medium.

3. The process of claim 1 wherein said inorganic salt is a sulfate.

4. The process of claim 3, wherein said salt is ammonium sulfate.

5. The process of claim 1 wherein said salt is chosen from the group consisting of sodium acetate and sodium potassium tartrate.

6. The process of claim 1 wherein said starch comprises corn starch.

7. The process of claim 6 wherein said cornstarch comprises between about 50 and about 80 percent amylose.

8. The process of claim 1 wherein said alkaline solution of starch comprises white water effluent from a papermaking process.

9. The process of claim 1 wherein said alkaline solution of starch additionally comprises an insoluble extender.

10. The process of claim 9 wherein said insoluble extender comprises an inorganic pigment.

11. The process of claim 10 wherein said inorganic pigment comprises titanium dioxide.

12. The process of claim 1, wherein said alkaline solution of starch additionally comprises a water soluble paper treating agent.

13. A process for the production of a paper product including water insoluble starch fluids, which comprises:

(a) providing an aqueous, alkaline solution of a normally water-insoluble starch in finely divided form, said alkaline solution of starch comprising white water effluent from a papermaking process, (b) introducing said finely divided starch solution into an agitated, aqueous precipitating medium, said aqueous precipitating medium comprising a salt solution, to thereby produce starch fibrids characterized by having both film and fiber morphology, (c) separating said starch fibrids which are insoluble in water from said aqueous precipitating medium, (d) incorporating said starch fibrids into a papermaking wood pulp in an amount ranging from 1 percent to about 60 percent by weight, and (e) preparing a paper product from said papermaking wood pulp including said starch fibrids.

* * * * *